US005234318A

United States Patent [19]

Brandon

[11] Patent Number: 5,234,318

[45] Date of Patent: Aug. 10, 1993

[54] CLIP-ON RADIAL TIP SEALS FOR STEAM AND GAS TURBINES

[76] Inventor: Ronald E. Brandon, 627 Jubilee St., Melbourne, Fla. 32940

[21] Appl. No.: 8,358

[22] Filed: Jan. 22, 1993

[51] Int. Cl.[5] ..... F04D 29/08

[52] U.S. Cl. ..... 416/192; 416/189; 415/170.1

[58] Field of Search ..... 416/192, 189; 415/170.1, 173.1

[56] References Cited

U.S. PATENT DOCUMENTS

| | | | |
|---|---|---|---|
| 969,843 | 9/1910 | Clarke | 416/192 |
| 1,152,812 | 9/1915 | Hanzlik | 416/192 |
| 1,792,288 | 2/1931 | Dempster | 415/111 |
| 1,999,739 | 4/1935 | Rasmussen | 416/174 |
| 2,345,918 | 4/1944 | Dahlstrand | 416/189 |
| 2,366,142 | 12/1944 | Allen | 416/189 |
| 2,910,269 | 10/1959 | Haworth et al. | 415/173.6 |
| 3,053,505 | 9/1962 | Welsh | 416/192 |
| 3,065,955 | 11/1962 | Harlin | 415/173.6 |
| 3,314,651 | 4/1967 | Beale | 415/173.6 |
| 3,408,048 | 10/1968 | Scalzo | 415/173.6 |
| 3,854,842 | 12/1974 | Caudill | 415/173.1 |
| 4,816,213 | 3/1989 | Groenendaal, Jr. | 415/134 |
| 5,154,581 | 10/1992 | Borufka et al. | 415/173.6 |

FOREIGN PATENT DOCUMENTS

| | | | |
|---|---|---|---|
| 43798 | 9/1917 | Sweden | 416/192 |
| 779592 | 11/1980 | U.S.S.R. | 416/192 |
| 787689 | 12/1980 | U.S.S.R. | 416/192 |

*Primary Examiner*—John T. Kwon
*Attorney, Agent, or Firm*—Ross, Ross & Flavin

[57] ABSTRACT

A tip seal arrangement is provided for steam and gas turbines that allows the tip seals to be mounted on shrouds in such a way as to be easily replaceable while ensuring a minimum of contact between tenons and particles carried by leaking turbine fluid.

The invention is practiced by multiple segments that clip to the shrouds so as to provide a full circle with a stand-up radial seal that projects outwardly from the shroud to provide a small clearance with the stationary diaphragm or casing that surrounds the rotating blades with the individual segments being relatively easy to remove and replace.

11 Claims, 2 Drawing Sheets

CLIP-ON RADIAL TIP SEALS FOR STEAM AND GAS TURBINES

BACKGROUND OF THE INVENTION

1. Field of the Invention

In most turbine stages a replaceable radial tip seal is mounted on a stationary shell or diaphragm. The tip seal is positioned to hold a small operating clearance with the rotating blade outer cover or shroud, so as to minimize leakage that would otherwise bypass the rotating blades or buckets. The tip seals usually employ a geometry that includes a thin tooth or teeth that, should a rub occur between the tooth and the shroud of the rotating blade, the tooth could be rubbed away with a minimum of heat and damage to the shroud.

With this arrangement, the leakage steam is forced to pass close to the outer surface of the shroud, usually very close to the tenon that secures the shroud to the rotating blades. In some turbine locations the leakage fluid may also include water droplets or solid particles such as iron oxide or hard particles such as weld beads. These droplets or particles are harmful to the tenons and, if sufficient damage occurs, can allow the shrouds to fly off, causing expensive repairs and lost operating periods.

Where such particles are known to be present, it would sometimes be preferable to position the tip seal on the shroud itself. In this way, leakage steam and any accompanying particles would be predominantly kept in zones where tenon damage would be minimized.

2. Description of the Prior Art

Turbine designers occasionally use such designs as above described. Where used, however, the seal is manufactured as an integral part of the shroud. This means that should a severe rub occur, the tooth damage is very difficult to repair or replace.

Radial seals have been previously mounted on rotating parts; but only in such locations where adequate radial depth is present to permit grooves and locking devices Such radial depth is not present in bucket covers.

On hundreds of exiting turbines, tip seals have been removed to protect the tenon in spite of the serious increase in tip leakage. A simple, low cost, replaceable tip seal that discourages erosion and damage would be beneficial to both old and new turbines.

SUMMARY OF THE INVENTION

It is the object of the present invention to provide a simple tip seal arrangement that allows tip seals to be mounted on shrouds in such a way as to be easily replaceable. Further, the tip seals ensure a minimum of contact between tenons and particles carried by leaking turbine fluid.

The invention is practiced by multiple segments that clip to the shrouds so as to provide a full circle with a stand-up radial seal that projects outwardly from the shroud to provide a small clearance with the stationary diaphragm or casing that surrounds the rotating blades. The individual segments are relatively easy to remove and replace.

DESCRIPTION OF THE PREFERRED EMBODIMENTS

Figure 1:
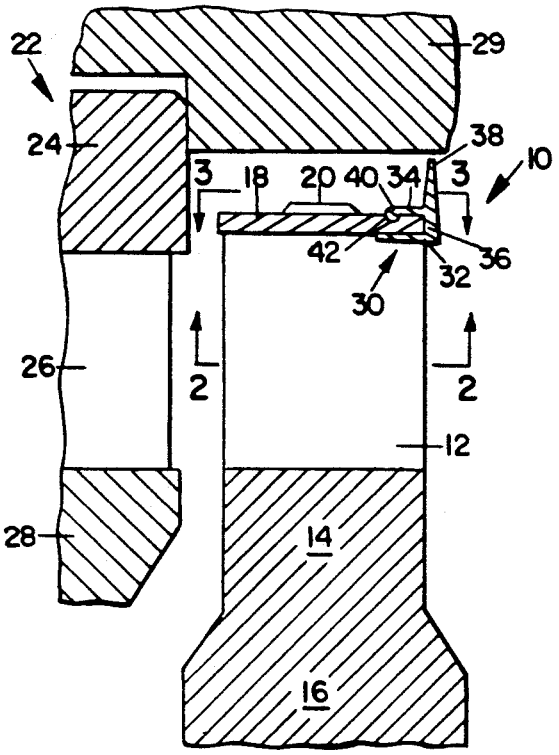
FIG. 1 is a partial schematic cross sectional view of a selected portion of a turbine stage and having a radial tip seal embodying the invention mounted on the downstream edge of a bucket shroud or cover.
Figure 5:
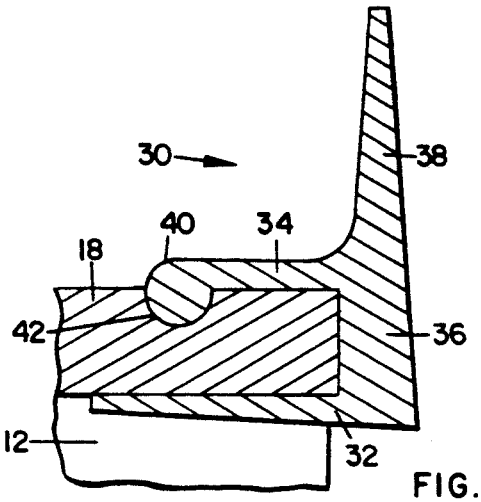
FIG. 5 is an enlarged, fragmentary front elevational view of the radial tip seal of FIG. 1.
Figure 4:
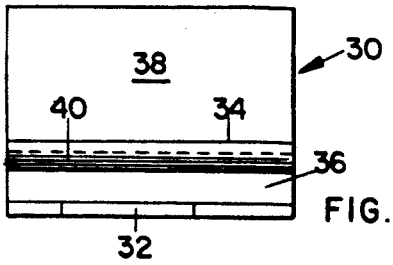
FIG. 4 is a side elevational view of the radial tip seal of the invention as seen from the left of FIG. 1.

Referring to FIG. 1, some of the key elements of a turbine stage 10 are illustrated. Turbine buckets or rotating blades 12 are mounted in a full circle on a turbine wheel 14. The wheel is part of a shaft 16, not fully shown. A bucket shroud or cover 18 forms a full circle, or almost full circle and is mounted on the outer periphery of buckets 12 and is held securely against the buckets by tenons 20 which function much like rivets. Tenons 20 are an integral part of buckets 12 extending through holes, not shown, in cover 18, then being peened to secure the covers to the buckets.

Stationary parts include a diaphragm 22 comprised of an outer ring 24, a circle of nozzles 26, and an inner ring 28. A casing or shell 29 supports and aligns the stationary parts to the rotating parts.

A radial tip seal 30 embodying a preferred form of the invention is shown mounted on the downstream edge of bucket cover 18. The seal is of an essentially inverted F shape in elevation and includes a flat horizontally-extending lower arm 32 positioned tightly against the lower surface of bucket cover 18, and a substantially flat upper arm 34 disposed in spaced parallelism to lower arm 32 and positioned tightly against the upper surface of the bucket cover.

Arms 32 and 34 are interconnected along an outer edge by an upstanding web 36 which extends upwardly above the plane of upper arm 34 in the form of a narrow tooth 38 having an upper free end disposed in close adjacency to the inner face of casing or shell 29 to minimize leakage between seal 30 and the shell.

The inner end of upper arm 34 terminates in a semi-circular rib 40 which engages in a matching semi-circular groove 42 in bucket cover 18 to axially secure radial seal 30 to the bucket cover.

Seal 30 is installed in multiple segments to form a full circle around cover 18. As illustrated, the individual seal segments are pushed onto the bucket cover to cause engagement of rib 40 in the matching groove 42 machined in the bucket cover. This latches the seal to the bucket cover. Each segment of seal 30 butts close to each adjacent segment with sufficient clearance to permit a proper amount of thermal differential expansion.

Figure 2:
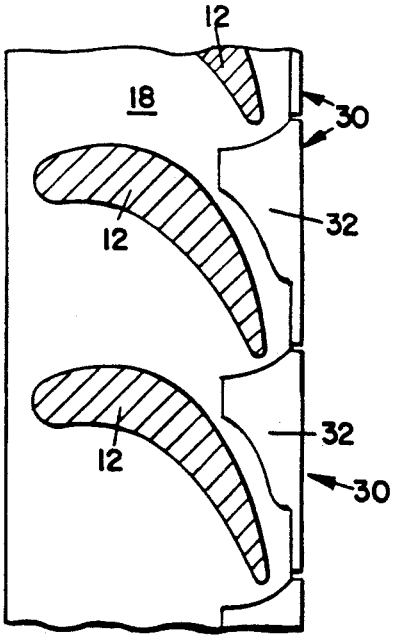
FIG. 2 is a partial schematic, cross sectional view looking radially outwardly along line 2—2 of FIG. 1.

As seen in FIG. 2, the inner end of lower arm 32 of seal 30 is so shaped as to allow assembly without interfering with the individual buckets 12.

Figure 3:
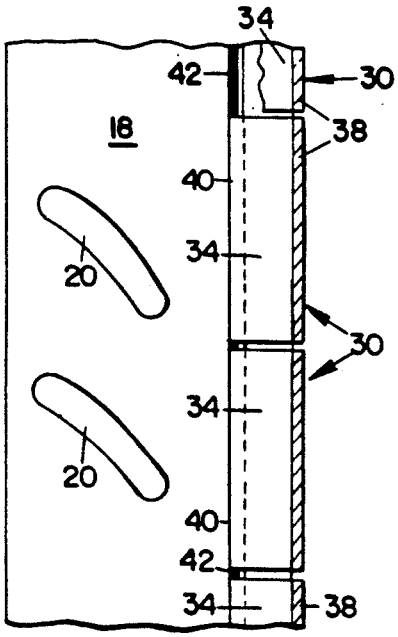
FIG. 3 is a partial schematic cross sectional view looking radially inwardly along line 3—3 of FIG. 1.

As seen in FIG. 3, rib 40 on seal upper arm 34 and groove 42 in bucket cover 18 are positioned to avoid interference with tenons 20.

It will be recognized that seal 30 can be mounted at the upstream or inlet edge of the bucket cover instead of or in addition to the downstream position illustrated in FIG. 1.

Figure 6:
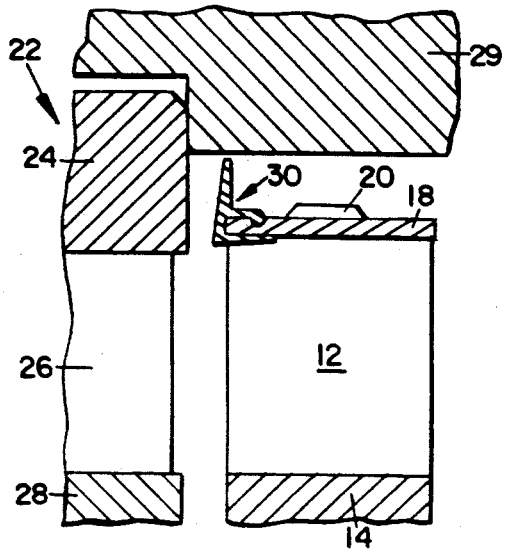
FIG. 6 is a partial schematic cross sectional view showing the tip seal of the invention mounted on the upstream edge of a bucket shroud or cover.

In FIG. 6, seal 30 is mounted at the upstream or inlet edge of bucket cover 18.

Figure 7:
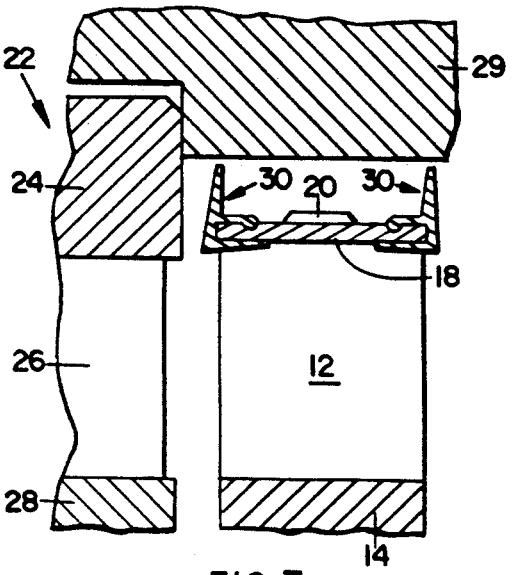
FIG. 7 is a partial schematic cross sectional view showing the tip seal of the invention mounted on both the upstream and downstream edges of a bucket shroud or cover.

In FIG. 7, seals 30 are mounted at both the upstream and downstream edges of bucket cover 18.

In addition to or instead of the grooved latching construction illustrated, brazing or silver soldering could be used. Other means can also be considered such as spot welding, bent tabs or other interlocking techniques.

Figure 8:
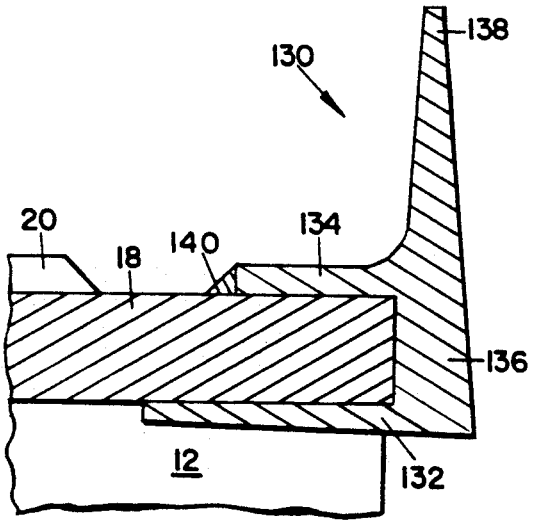
FIG. 8 is a partial cross sectional view of a first alternate form of radial tip seal.

FIG. 8 shows a first form of alternative mounting. A radial tip seal 130 is shown fastened to bucket cover 18.

Seal 130 is similar to seal 30 and is of an essentially inverted F shape in elevation and includes a flat horizontally-extending lower arm 132 positioned tightly against the lower surface of bucket cover 18, and a substantially flat upper arm 134 disposed in spaced parallelism to lower arm 132 and positioned tightly against the upper surface of the bucket cover.

Arms 132 and 134 are interconnected along an outer edge by an upstanding web 136 which extends upwardly above the plane of upper arm 134 in the form of a narrow tooth 138 having an upper free end disposed in close adjacency to the inner face of casing or shell 29, not shown, to minimize leakage between seal 130 and the shell.

The inner end of upper arm 134 is fastened to the upper surface of bucket cover 18 as by brazing 140.

Figure 9:
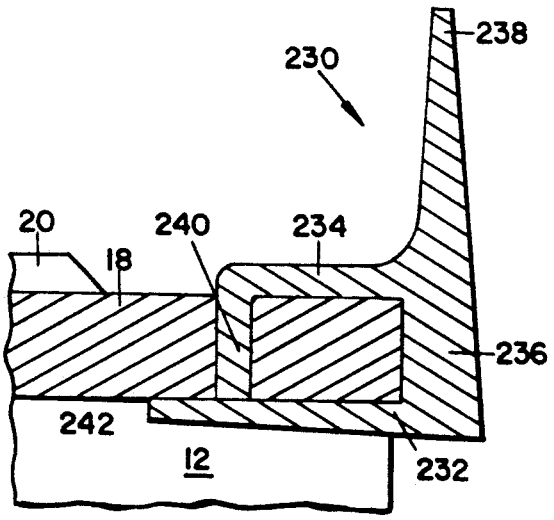
FIG. 9 is a partial cross sectional view of a second alternate form of radial tip seal.

FIG. 9 shows a second form of alternative mounting. A radial tip seal 230 is shown fastened to bucket cover 18.

Seal 230 is similar to seals 30 and 130 and is of an essentially inverted F shape in elevation and includes a flat horizontally-extending lower arm 232 positioned tightly against the lower surface of bucket cover 18, and a substantially flat upper arm 234 disposed in spaced parallelism to lower arm 232 and positioned tightly against the upper surface of the bucket cover.

Arms 232 and 234 are interconnected along an outer edge by an upstanding web 236 which extends upwardly above the plane of upper arm 234 in the form of a narrow tooth 238 having an upper free end disposed in close adjacency to the inner face of casing or shell 29, not shown, to minimize leakage between seal 230 and the shell.

Locking tabs 240 are provided on the inner end of upper arm 234 and depend therefrom in spaced parallelism to web 236.

Tabs 240 are receivable in vertically-disposed openings 242 which extend through cover 18.

Openings 242 in cover 18 are so spaced as to be positioned between tenons 20, and tabs 240 on seal 230 are so spaced as to align with openings 242 and snap into the openings to latch the seal to the cover.

Various other modifications will occur to those skilled in the turbine disciplines. It is desired to secure, by the appended claims, all such modifications that may fall within the true spirit and scope of the invention.

I claim:

1. In a turbine stage which includes rotating buckets having upstream and downstream edges, covers attached to the buckets by tenons, and stationary parts surrounding the buckets and covers, the improvement comprising: clip-on segmented tip seals, means fastening the tip seals to the bucket covers to form a nearly complete full circle of small clearance seals with the surrounding stationary parts of the turbine stage, said seals being at a larger diameter than the bucket covers and said tenons.

2. In a turbine stage according to claim 1, wherein the means fastening the tip seals to the bucket covers are ribs on the tip seals which interlock with grooves in the bucket covers.

3. In a turbine stage according to claim 1, wherein the means fastening the tip seals to the bucket covers is brazing.

4. In a turbine stage according to claim 1, wherein the means fastening the tip seals to the bucket covers are tabs on the tip seals which interlock with aligned openings in the bucket covers.

5. In a turbine stage according to claim 1, wherein the tip seals are fastened to the covers at the upstream edge of the buckets.

6. In a turbine stage according to claim 1, wherein the tip seals are fastened to the covers at the downstream edge of the buckets.

7. In a turbine stage according to claim 1, wherein the tip seals are fastened to the covers at the upstream and downstream edges of the buckets.

8. In a turbine stage according to claim 1, wherein the tip seals are of an essentially inverted F shape in elevation and include a flat horizontally-extending lower arm positioned tightly against the lower surface of the bucket cover and a substantially flat upper arm disposed in spaced parallelism to the lower arm and positioned tightly against the upper surface of the bucket cover, the upper and lower arms being interconnected along an outer edge by an upstanding web which extends upwardly above the plane of the upper arm in the form of a narrow tooth having an upper free end disposed in close adjacency to the stationary parts to minimize leakage between the seal and the stationary parts.

9. In a turbine stage according to claim 8, wherein the upper and lower arms are of such size and configuration as not to interfere with the buckets and tenons.

10. In a turbine stage according to claim 8, wherein the means fastening the tip seals to the bucket covers are ribs on the upper arms which interlock with grooves in the bucket covers.

11. In a turbine stage according to claim 8, wherein the means fastening the tip seals to the bucket covers are tabs on the upper arms which interlock with aligned openings in the bucket covers.

* * * * *